US012377333B2

(12) United States Patent
Hernandez Taboada

(10) Patent No.: US 12,377,333 B2
(45) Date of Patent: Aug. 5, 2025

(54) WEIGHTED SOCCER TRAINING BALL

(71) Applicant: Esteban Ruben Hernandez Taboada, Houston, TX (US)

(72) Inventor: Esteban Ruben Hernandez Taboada, Houston, TX (US)

( * ) Notice: Subject to any disclaimer, the term of this patent is extended or adjusted under 35 U.S.C. 154(b) by 0 days.

(21) Appl. No.: 16/942,761

(22) Filed: Jul. 29, 2020

(65) Prior Publication Data

US 2021/0146211 A1 May 20, 2021

Related U.S. Application Data

(60) Provisional application No. 62/879,992, filed on Jul. 29, 2019.

(51) Int. Cl.
*A63B 69/00* (2006.01)
*A63B 41/10* (2006.01)

(52) U.S. Cl.
CPC ..... *A63B 69/002* (2013.01); *A63B 41/10* (2013.01); *A63B 2225/62* (2013.01); *A63B 2243/0025* (2013.01)

(58) Field of Classification Search
CPC ... A63B 69/002; A63B 41/10; A63B 2225/62; A63B 2243/0025
USPC ..... 473/446, 438, 442, 594
See application file for complete search history.

(56) References Cited

U.S. PATENT DOCUMENTS 1,863,170 A * 6/1932 Scudder ..... A63B 41/04 473/603
2,078,141 A * 4/1937 Hesper ..... A63B 41/085 473/599
2,352,872 A * 7/1944 Voit ..... A63B 41/08 473/605
2,494,796 A * 1/1950 Brown ..... A63B 41/08 473/605
3,863,923 A * 2/1975 Anderson ..... A63B 39/06 473/604
4,071,241 A * 1/1978 Cortes Garcia ..... A63B 43/02 473/424
4,463,951 A * 8/1984 Kumasaka ..... A63B 37/02 473/601
4,542,902 A * 9/1985 Massino ..... A63B 37/02 473/602
4,738,450 A * 4/1988 Wexler ..... A63B 37/06 473/598

(Continued)

FOREIGN PATENT DOCUMENTS

GB 2457941 A * 9/2009 ..... A63B 41/08

OTHER PUBLICATIONS

Wikipedia, Basketball, last edited Mar. 21, 2022 https://en.wikipedia.org/wiki/Basketball (Year: 2022).*

(Continued)

*Primary Examiner* — Mitra Aryanpour
(74) *Attorney, Agent, or Firm* — Delphine James

(57) ABSTRACT

The present invention discloses a soccer training ball with an outer covering of ball that consists of a plurality of panels disposed between two opposing apex panels. The plurality of panels encircles the spherical ball each panel substantially extending the diameter of the spherical ball between the outer peripheral edge of the pair of opposing apex panels. The opposing apex members are preferably polygonal shape.

9 Claims, 2 Drawing Sheets

(56) References Cited

U.S. PATENT DOCUMENTS 4,830,373 A * 5/1989 Dehnert ..... A63B 41/08 473/599
5,286,020 A * 2/1994 Caruso ..... A63B 41/00 473/603
5,335,907 A 8/1994 Spector
5,580,049 A * 12/1996 Brantley ..... A63B 41/08 473/599
5,967,917 A * 10/1999 Feeney ..... A63B 41/08 473/607
6,402,647 B1 * 6/2002 Haseltine ..... A63B 41/00 473/423
D478,641 S * 8/2003 Kuehne ..... D21/713
D495,386 S * 8/2004 Bryant ..... D21/713
6,793,597 B2 * 9/2004 Awan ..... A63B 41/08 473/594
7,037,224 B1 * 5/2006 Page ..... A63B 69/0071 473/604
D544,931 S * 6/2007 Laliberty ..... D21/713
8,021,252 B2 * 9/2011 Goedoen ..... A63B 45/02 473/604
2015/0343286 A1 * 12/2015 Aguda ..... A63B 69/002 473/446
2018/0015334 A1 * 1/2018 Solotoff ..... A63B 43/008 473/446
2021/0146211 A1 * 5/2021 Taboada ..... A63B 69/002 473/446

OTHER PUBLICATIONS

Baskethrough Basketball, last updated 2022 https://www.breakthroughbasketball.com/basketballs/size-chart.html (Year: 2015).*
StayOnTheCourt.com, last updated 2022 https://stayonthecourt.com/basketball-size-chart/?nowprocket=1 (Year: 2022).*
What Things Weight—Weight of Basketball, last updated 2022 https://whatthingsweigh.com/how-much-does-a-basketball-weigh/ (Year: 2017).*

* cited by examiner

WEIGHTED SOCCER TRAINING BALL

BACKGROUND OF THE INVENTION

This is Patent Request the Benefit of Provisional Application

This invention relates to training devices for athletes more specifically it relates to soccer training devices. Soccer is a team sport played with a spherical ball between two teams of eleven players on a rectangular field with a goal at each end. The object of the game is to score by moving the ball beyond the goal line into the opposing goal.

Soccer is played by millions of players all over the world making it one of the world's most popular sports. Soccer balls are required to meet specific standards by various the international and collegiate governing body of soccer including the NCAA.

The present invention provides a specialized training ball to support the development of athletes' agility and strength in the game of soccer.

SUMMARY OF THE INVENTION

One object of the present invention is to provide a soccer training, which can be easily and efficiently manufactured and marketed. The present invention provides a soccer training device comprising a spherical ball with an outer cover having an internal bladder with equivalent dimensions. The training device has a larger weight, diameter and circumference than a standard soccer ball thereby increasing the players agility and strength.

Together with other objects of the invention, along with the various features of novelty which characterize the invention, are pointed out with particular in the claims annexed to and forming a part of this disclosure.

The major advantages of the invention are set forth in part herein and in part will be obvious herefrom, or may be learned by practice with the invention, the same being realized and attained by means of the instrumentalities and combinations pointed out in the appended claims.

The accompanying drawings referred to herein and constituting a part hereof illustrate preferred embodiments of the invention and together with the description, serve to explain principles of the invention.

BRIEF DESCRIPTION OF THE DRAWINGS

This invention is described by appended claims in relation to description of a preferred embodiment with reference to the following drawings which are described briefly as follows:

DETAILED DESCRIPTION OF THE INVENTION

Figure 1:
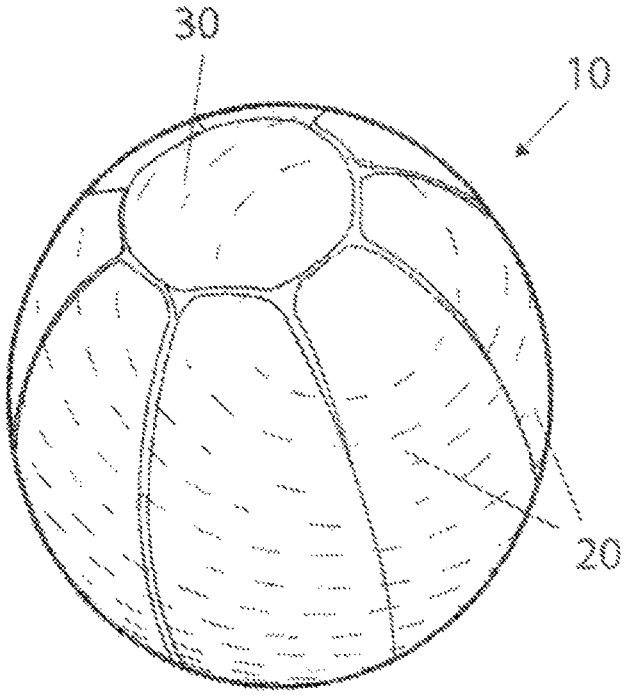
FIG. 1 illustrates a frontal perspective view of the Soccer Ball.
Figure 2:
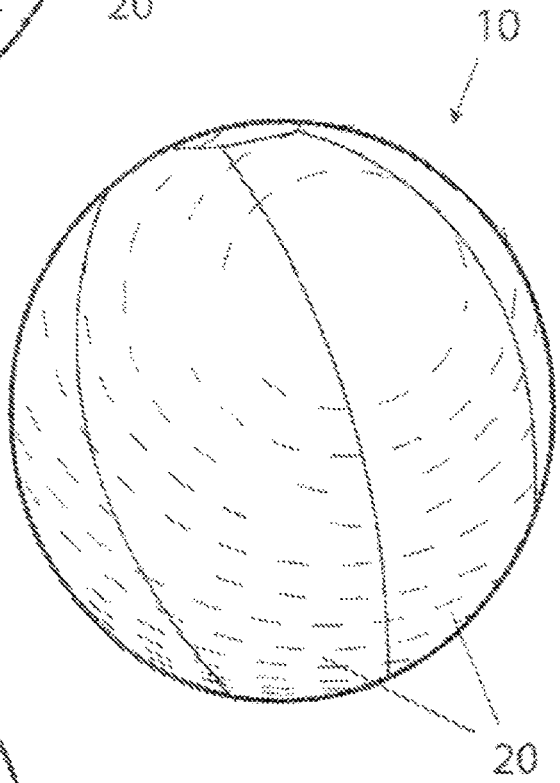
FIG. 2 illustrates a backplane perspective view of the Soccer Ball.
Figure 3:
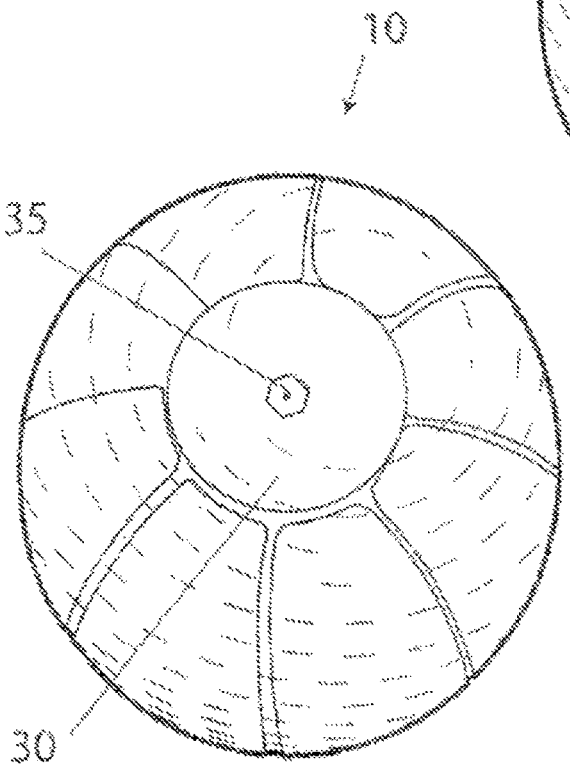
FIG. 3 illustrates a frontal view of the apex panel of the Soccer Ball.

With reference now to the drawings, and in particular to FIGS. 1-5 thereof a spherical weighted soccer training ball embodying the principles and concepts of the present invention and generally designated by the reference numeral 10 will be described.

The outer cover (51) of the soccer ball (10) is spherical in shape and is made of a strong, durable and resilient material, preferably leather which is coated with a water-proofing material such as polyurethane. The outer covering (51) (molding is molded over an interior bladder that is preferably made of butyl, latex, rubber or another suitable material.

In the preferred embodiment, the outer covering (50) of ball consists of a plurality of horizontal panels (20) disposed between two opposing apex panels (30). The plurality of panels (30) encircles the spherical ball each horizontal panel substantially extending the diameter of the spherical ball between the outer peripheral edge of the pair of opposing apex panels. The opposing apex members (30) are preferably polygonal shape. In the present invention each apex panel can be pentagonal, hexagonal or octagonal in shape. The number of sides of the apex panels (30) can define the number of horizontal panels (20). Additionally, each horizontal panel (20) can be further subdivided into one or more horizontal panels as desired. In other embodiments the longitudinal panels can have a plurality of polygonal shapes (62, 59).

There are two main types of materials used to make soccer balls: PVC (Poly Vinyl Carbonate) and PU (Polyurethane). PVC is more affordable and can be more durable than PU. Scuff-resistant PVC is generally used in training soccer balls. PVC is also used in indoor soccer balls, futsal balls and street soccer balls. PU is usually reserved for higher end match balls and premium match balls. A PU soccer ball is often softer than a PVC soccer ball. PU tends to have a better responsiveness off the foot. With the present invention, the outer covering is preferably made of leather. The outer covering can be coated with a protective covering that reduces water absorption. However, a water absorption of a non-coated outer covering (51) can be utilized to increase strength training.

Glossy coatings are often used to aid in reducing water absorption and scuffing on softer PU soccer balls.

The bladder (50) is the insides of the soccer ball. It's the chamber that's filled with air to keep the soccer ball inflated. Soccer ball bladders are almost always butyl or latex. Premium soccer balls usually have natural latex bladders. Latex bladders are softer, with a better feel. However, latex soccer ball bladders do not retain air and shape as well as butyl soccer ball bladders do and require more frequent inflation. Butyl soccer ball bladders are known for their excellent air retention. Air is placed into bladder (50) through port (35).

NFHS approved balls meet the following criteria:

The ball must be spherical.

The outer casing must be leather or approved synthetic, and it must be weather/rain resistant.

The circumference of the ball cannot be more than 28 inches nor less than 27 inches.

The weight of the ball at the start of the game cannot be more than 16 ounces nor less than 14 ounces.

NCAA approved balls meet the following criteria:

The circumference of the ball cannot be more than 28 inches nor less than 27 inches.

The weight of the ball at the start of the game cannot be more than 16 ounces nor less than 14 ounces, and the weight cannot ever exceed 16.75 ounces, even when wet and used.

The pressure of the ball should be 8.5 to 15.6 psi.

The ball must be spherical.

The outer casing must be leather or approved synthetic, and no material shall be used in its construction that might prove dangerous to players.

There are no restrictions on the color of the ball.

The construction of the present invention is as follows:

it is spherical in shape and the circumference of the ball will span from about 65.94 centimeters to about 78.5 centimeters; alternatively the ball may have a circumference from about 77 centimeters to a about 81 centimeters;

the diameter of the ball will extend from between 21 centimeters to a maximum of 25 centimeters; alternatively the ball may have a diameter of about 24.5 centimeters to about 25.8 centimeters;

the weight of the ball will range from 500 grams minimum to 900 grams maximum (i.e. 1.1 pounds to 1.98 pounds); and there is no restriction in color or the number of panels.

Figure 4:
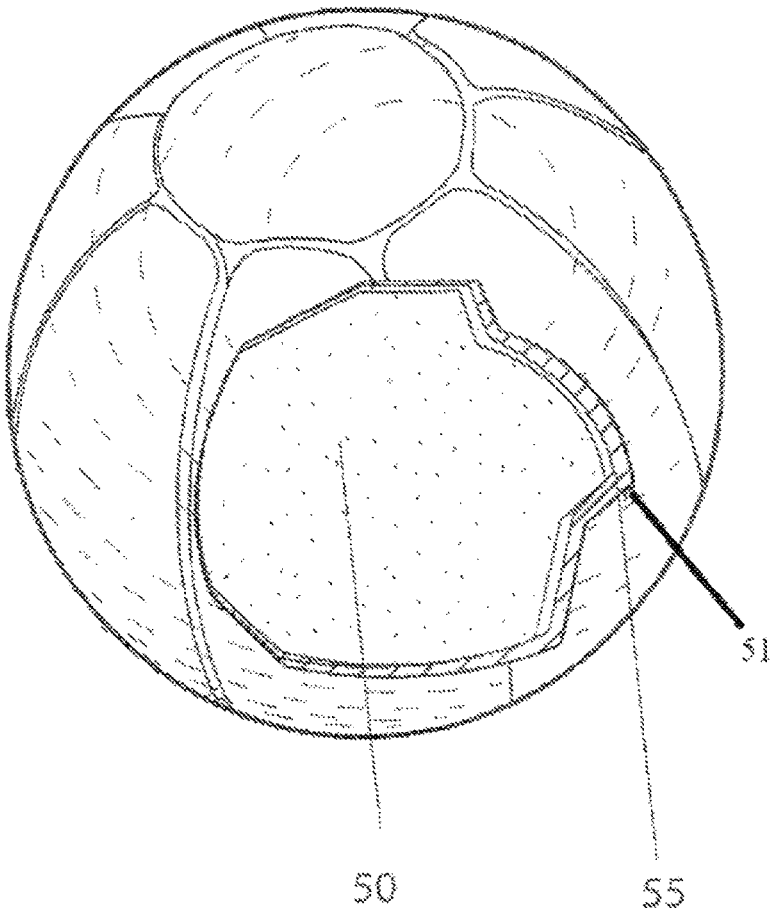
FIG. 4 illustrates an alternative embodiment of the Soccer Ball.
Figure 5:
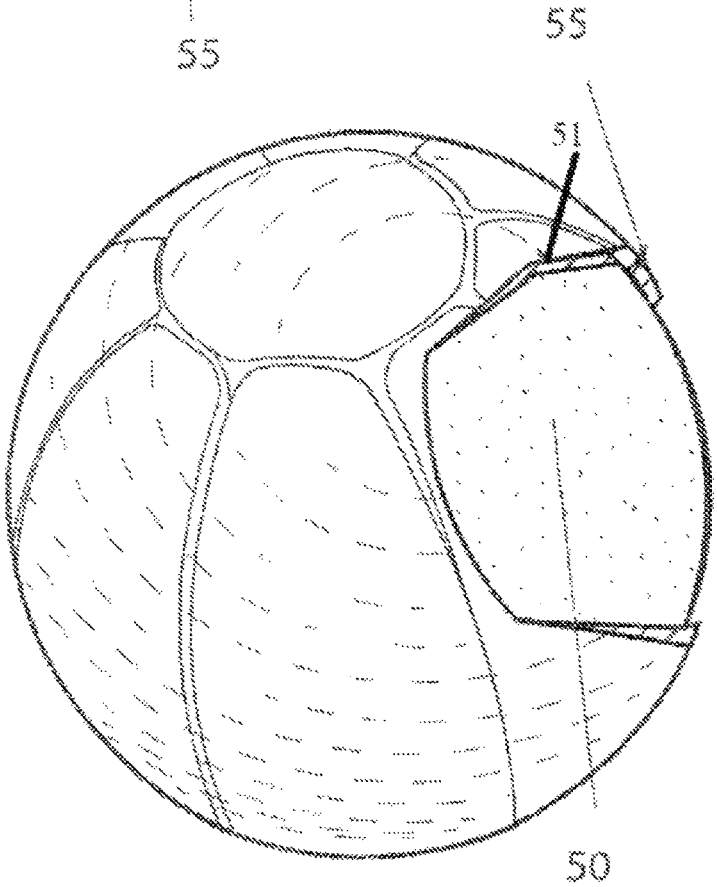
FIG. 5 illustrates a cutaway view of the Soccer Ball.

As shown in FIGS. 4 and 5 weight (55) is added below outer covering (51).

What is claimed is:

1. A weighted soccer training ball, comprising:

an internal bladder;

an outer cover made of a durable, resilient material;

the outer cover molded over the internal bladder, the outer cover including a plurality of panels arranged between a pair of opposing apex panels encircling the internal bladder;

wherein the pair of opposing apex panels have a polygonal shape with a pre-determined number of sides;

each of the plurality of panels extending laterally between the pair of opposing apex panels;

wherein the plurality of panels and the pair of opposing apex panels being attached together;

the ball having an outer circumference between 65.94 centimeters and 78.5 centimeters, and having an outer diameter between 21 centimeters to a maximum of 25 centimeters;

one or more weights positioned below the outer cover of the ball, wherein the overall weight of the ball falls between 500 grams to about 900 grams; and wherein a valve is positioned on the outer cover of the ball for inflating the soccer training ball;

wherein the weighted soccer ball provides a specialized training ball to support the development of athletes' agility and strength in the game of soccer.

2. The weighted soccer training ball of claim 1 wherein the pair of opposing apexes panels has a shape selected from the group hexagonal, pentagon, and octagon.

3. The weighted soccer training ball of claim 1 wherein the predetermined number of sides of the pair of apex panels define a number of the plurality of panels.

4. The soccer weighted training ball of claim 1 wherein each of the plurality of panels further comprise a plurality of polygonal shapes.

5. The weighted soccer training ball of claim 1 wherein the internal bladder is made of two-ply butyl.

6. The weighted soccer training ball of claim 1 wherein the internal bladder is made of latex.

7. The weighted soccer training ball of claim 1 wherein the outer cover is made a leather material.

8. The weighted soccer training ball of claim 7 wherein the leather material is coated with polyurethane which reduces water consumption within the outer cover.

9. The weighted soccer training ball of claim 1 wherein the pressure of the soccer ball is between 8.5 psi to 15.6 psi.

* * * * *